US007758019B2

(12) United States Patent
Braddick

(10) Patent No.: US 7,758,019 B2
(45) Date of Patent: Jul. 20, 2010

(54) SAFETY VALVE

(75) Inventor: Britt O. Braddick, Houston, TX (US)

(73) Assignee: TIW Corporation, Houston, TX (US)

( * ) Notice: Subject to any disclaimer, the term of this patent is extended or adjusted under 35 U.S.C. 154(b) by 267 days.

(21) Appl. No.: 11/786,495

(22) Filed: Apr. 12, 2007

(65) Prior Publication Data

US 2008/0251259 A1 Oct. 16, 2008

(51) Int. Cl.
*F16K 5/06* (2006.01)

(52) U.S. Cl. ..... 251/315.06; 166/332.3; 251/315.01

(58) Field of Classification Search ..... 251/315.01, 251/315.06, 340, 315.1, 315.13; 166/330, 166/331, 332.1–332.3
See application file for complete search history.

(56) References Cited

U.S. PATENT DOCUMENTS 903,451 A * 11/1908 Clark ..... 251/340
988,017 A * 3/1911 Neumeyer ..... 251/340
3,386,701 A * 6/1968 Potts ..... 251/229
4,270,606 A * 6/1981 McStravick et al. ..... 166/181
4,270,607 A * 6/1981 Cardenas et al. ..... 166/270.1
4,270,849 A 6/1981 Kalbfleisch
4,303,100 A 12/1981 Kalb
4,310,051 A * 1/1982 Mott ..... 166/323
4,340,008 A 7/1982 Mendelson
4,462,693 A 7/1984 Buschbom et al.
4,476,935 A 10/1984 Hynes et al.
4,508,173 A * 4/1985 Read ..... 166/330
4,550,980 A 11/1985 Shingu
4,610,300 A * 9/1986 Mullins et al. ..... 166/134
4,625,755 A 12/1986 Reddoch
4,715,445 A * 12/1987 Smith, Jr. ..... 166/377
4,869,450 A * 9/1989 Takeda et al. ..... 251/315.05
4,969,515 A 11/1990 Dollison
6,241,018 B1 * 6/2001 Eriksen ..... 166/215
6,289,911 B1 9/2001 Majkovic
6,637,456 B2 10/2003 Sett
6,640,824 B2 11/2003 Majkovic
6,742,597 B2 6/2004 Van Winkle et al.
7,021,386 B2 4/2006 Vick, Jr. et al.
7,040,409 B2 5/2006 Sangla
7,419,012 B2 * 9/2008 Lynch ..... 173/152
2003/0056829 A1 3/2003 Fretwell
2004/0084191 A1 * 5/2004 Laird ..... 166/387
2005/0279513 A1 * 12/2005 Eppink ..... 166/380
2006/0184139 A1 8/2006 Quigley et al.

* cited by examiner

*Primary Examiner*—John K Fristoe, Jr.
*Assistant Examiner*—Marina Tietjen
(74) *Attorney, Agent, or Firm*—Browning Bushman P.C.

(57) ABSTRACT

The safety valve includes a first generally tubular body 12 and a second generally tubular body 14 each having flow paths therein when the bodies are mated. A ball 20 rotates between open and closed position in a first seat 30 and a ball centering member 32 provided for engaging the ball. An outer actuator sleeve 40 is rotatable with respect to the first and second bodies, and a connecting member 50 acts between the actuator sleeve and the ball to rotate the ball.

19 Claims, 3 Drawing Sheets

SAFETY VALVE

FIELD OF THE INVENTION

The present invention relates to safety valves, which are sometimes referred to as kelly valves, and are commonly used in surface and downhole oilfield operations. More particularly, the present invention relates to an improved safety valve which is mechanically operable without internal fluid pressure affecting valve operability.

BACKGROUND OF THE INVENTION

Numerous types of safety valves and kelly valves have been devised over past decades. These valves are commonly used in oilfield operations to control the internal pressure in tubing. A safety valve is commonly located adjacent the rig floor, and a kelly valve conventionally receives a kelly and is located above the rig floor. While a blow-out preventer provides safety from well pressure in the annulus about the tubing string, the safety valve provides safety from internal tubing string pressure. Some safety valves are hydraulically or pneumatically operated, although mechanically operated safety valves are highly preferable for many applications due to their simplicity and high reliability. Mechanically operated safety valves may be controlled by surface operations, and the valves may be used on the surface or downhole below the rig floor to control tubing string flow.

A significant problem with mechanically operated safety valves is that the high internal fluid pressure within the tubing string and therefore within the valve acts upon the trunnions which form the rotatable axis or stem of the ball. These high forces cause significant frictional engagement between the rotating ball and the body of the valve, thereby detracting from the reliability of the valve, particularly under high pressure applications. High pressure forces on the valve may thus stop the valve from opening.

Various types of safety valves include an actuator, as disclosed in U.S. Pat. No. 4,270,849. U.S. Pat. No. 4,340,008 discloses a pressure balanced safety valve, and U.S. Pat. No. 4,550,980 discloses a safety valve with a lock mechanism. A safety valve for coiled tubing is the subject of U.S. Pat. No. 6,742,597. A safety valve which uses a flapper is disclosed in Publication 2005/0039922. Safety valves with ball valves are highly preferred over safety valves with other types of valve closure members.

Various other patents disclose improvements to valves, and in particular to safety or kelly valves. These patents include U.S. Pat. Nos. 4,310,051, 4,340,080, 4,303,100, 4,462,693, 4,476,935, 4,625,755, and 4,969,515. More recent patents of interest include U.S. Pat. Nos. 6,289,911 and 6,640,824. Additional publications include 2002/0066486, 2001/0037900, 2003/0056829, 2004/0045722, 2006/0184139 and 2002/0066486.

The disadvantages of the prior are overcome by the present invention, and an improved safety valve and method of actuating a safety valve are hereinafter disclosed.

SUMMARY OF THE INVENTION

In one embodiment, a safety valve includes a first generally tubular body having a first flowpath therein, and a second generally tubular body having a second flowpath therein. A ball is rotatable between an open position and a closed position for regulating flow between the first and second flowpaths. A first seat is provided for sealing between the first body and the ball when closed, and a ball centering member engages the ball at a position axially opposite the first seat with respect to a center of the ball. An outer actuator sleeve is rotatable with respect to the first and second bodies, and a connecting member acts between the actuator sleeve and the ball and moves axially in response to rotation of the outer sleeve, thereby rotating the ball between the closed position and the open position.

According to the method of the invention, the sleeve may be rotated by various mechanisms while the valve is at the surface of the well. Rotation of the sleeve moves the ball from a closed position to an open position, and from an open position back to a closed position.

These and further features and advantages of the present invention will become apparent from the following detailed description, wherein reference is made to the figures in the accompanying drawings.

DETAILED DESCRIPTION OF PREFERRED EMBODIMENTS

Figure 1:
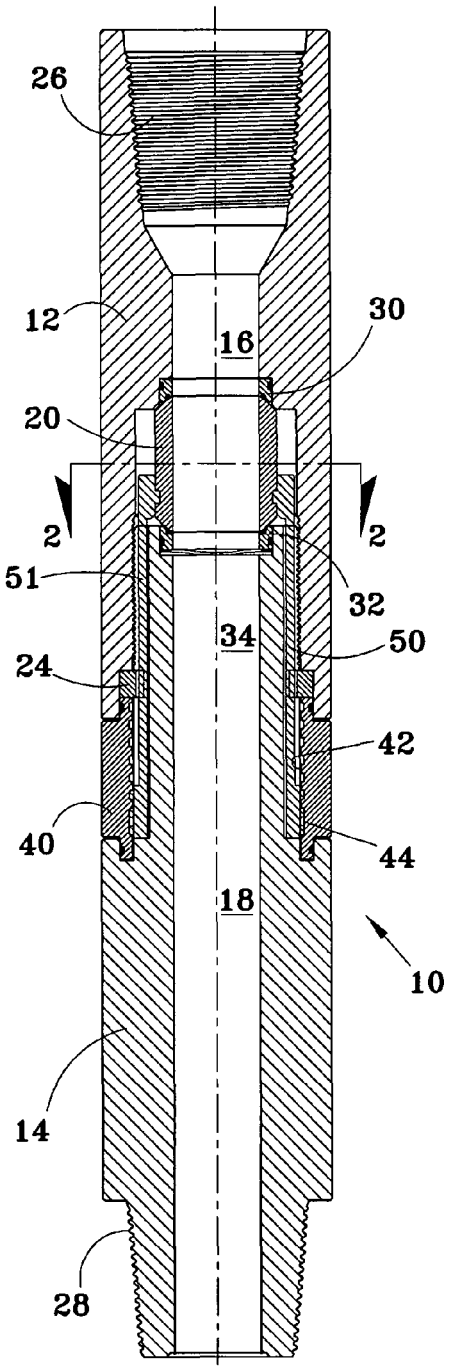
FIG. 1 is a cross-sectional view of the valve in the open position.

FIG. 1 illustrates one embodiment of a safety valve 10 according to the present invention. The safety valve includes a first generally tubular upper body 12 and a second generally tubular lower body 14. For the valve as depicted in FIG. 1, it is assumed that the tubing string internal pressure is provided from below the valve 10 and thus passes into the internal bore 18 of body 14, through the open ball 20, and into the internal bore 16 of the body 12. The bores 16 and 18 thus provide aligned flow paths through the first and second bodies when mated.

Figure 5:
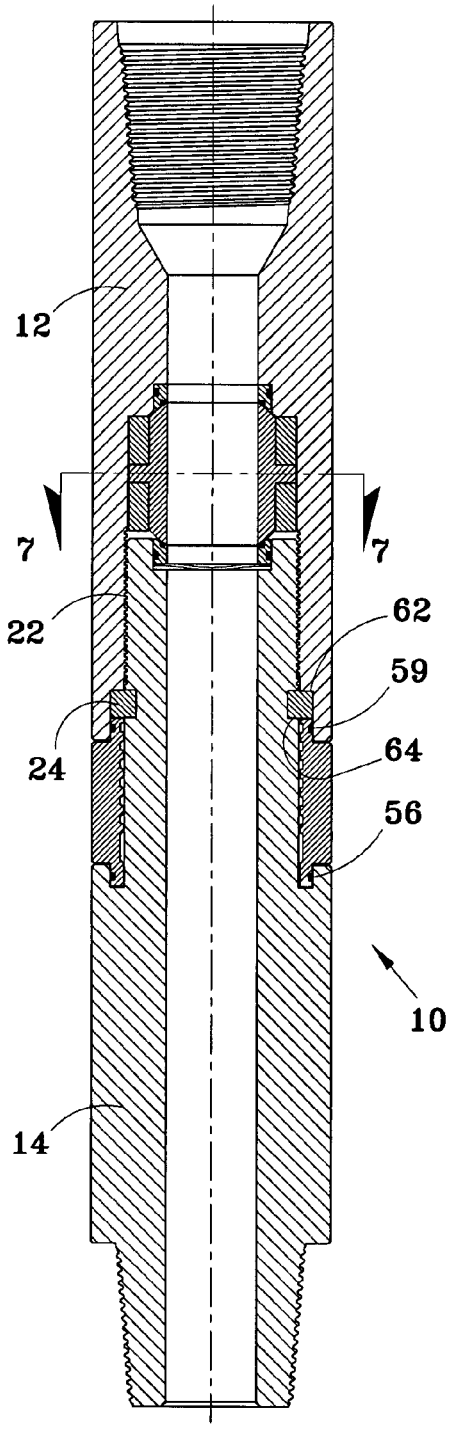
FIG. 5 is another cross-sectional view of the valve shown in FIGS. 1 and 3.

The second body 14 as shown is modified to receive the connecting members 50 and sleeve 40. As shown in FIG. 1, the connecting member 50 includes a pair of axially extending fingers 51 which move axially to rotate the ball in response to rotation of the sleeve 40. As shown in FIG. 5, which is a cross-section of the valve not passing through the connecting members, each of the first and second bodies includes threads 22 to connect the bodies. High torque forces are commonly transmitted between the tubular bodies, and a torque transmitting member 24 as shown in FIG. 5 is provided for transferring high torque forces between the bodies. The sleeve 40 is thus free to rotate independent of the forces transmitted between the upper and lower bodies 12, 14. Referring again to FIG. 1, the lower end of the second body 14 includes conventional external threads 28 for mating with a downstream lower tool or tubular, and the opposing upper end of the first body 12 includes internal threads 26 for mating with an upstream upper tool or tubular. The first and second bodies preferably have a substantially uniform outer diameter, and a substantially full bore passing through the bodies, and through the open ball. For the embodiment shown in FIG. 1, the safety valve may have an exemplary outer diameter of 6⅝", and an internal bore diameter of 2¾". Those skilled in the art will appreciate that actuating sleeve 40 and connecting member 50 may be provided on the upper body, if desired.

Ball 20 as shown in FIG. 1 cooperates a first seat 30 for sealing between the ball and the first body 12. A ball centering member 32, which may also act as a seat for sealing between the ball and the second tubular body, is provided on the opposite side of the ball from seat 30, i.e. opposite the seat 30 with respect to a rotational center of the ball. Seat 30 may thus include one internal elastomer seals for sealing with an inner cylindrical surface of the first body, and another seal for sealing with the outer surface of the ball. The second seat 32 may include a Bellville spring or a wave spring to exert a biasing force to press the seat 32 into engagement with the ball.

Figure 3:
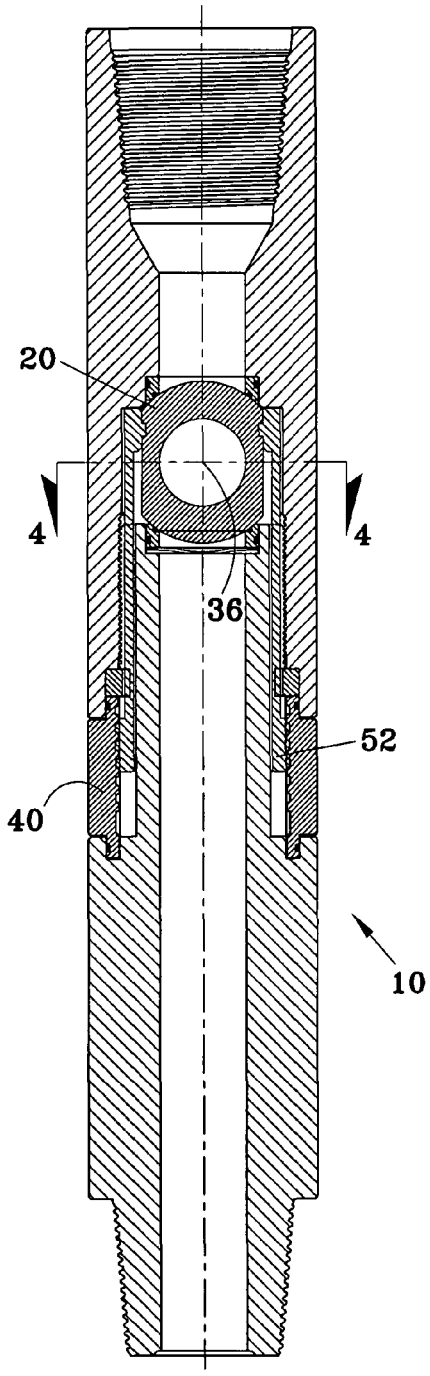
FIG. 3 is a cross-sectional view of the valve as shown in FIG. 1 in the closed position.

The term "ball" as used herein is intended in its broad-sense to refer to a rotatable closing member in a valve, with at least a portion of the outer surface of the ball being similar in configuration to a portion of a sphere. While the ball 20 as disclosed herein obviously need not be a sphere, the ball does rotate about a ball center 36, as shown in FIG. 3.

Figure 2:
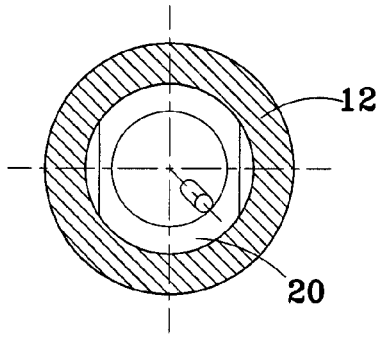
FIG. 2 is a cross-sectional view along line 2-2 of the valve as shown in FIG. 1.
Figure 4:
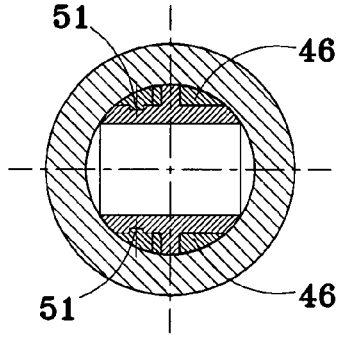
FIG. 4 is a cross-sectional view along line 4-4 of the valve as shown in FIG. 3.
Figure 7:
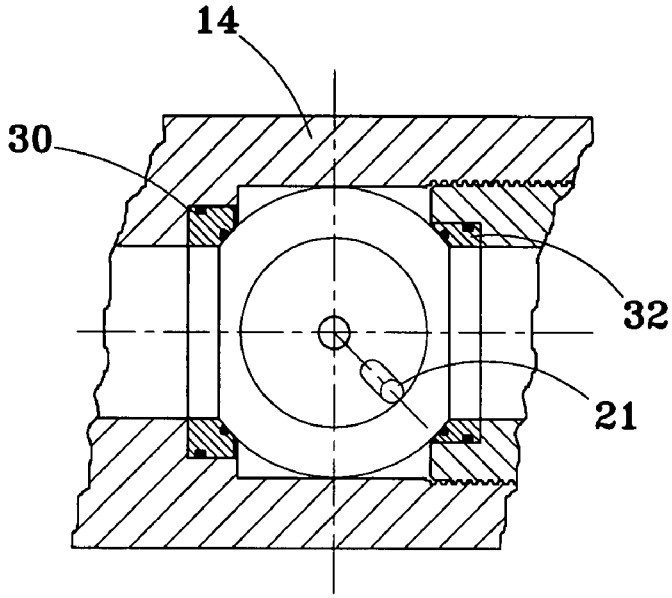
FIG. 7 is a cross-sectional view of the ball with a slot for receiving the tab of the connecting member.

FIG. 1 further illustrates the outer actuator sleeve 40 which is rotatable with respect to the first and second bodies. The O.D. of sleeve 40 is no greater than the O.D. of the upper and lower bodies, so that sleeve 40 does not get hung when lowered in a well. The outer actuator sleeve includes internal threads 42, and the pair of connecting members acting between the actuator sleeve and the ball 20 include mating threads 44. The actuator sleeve 40 is not axially compressed between the first and second members due to the torque transmitting member or torque ring 24. Those skilled in the art will appreciate that rotation of the actuator sleeve 40 moves the connecting members 50 axially from the position as shown in FIG. 1, which is an open valve position, to the position as shown in FIG. 3, which is a closed valve position. The valve includes a pair of guide blocks 46 as shown in FIGS. 2 and 4 which receive the trunnions 48 of the ball 20, and thereby provide an axis of rotation for the ball. The ball also includes a slot 21, as shown in FIG. 7, for receiving a tab 53 at the upper end of connecting members 50, as shown in FIG. 3, so that axial movement of the connecting members rotates the ball about the ball axis.

In a preferred embodiment, the torque transmitting member or torque ring includes one or more arcuate ring segments spaced between torque shoulders 62, 64 on the first and second bodies, as shown in FIG. 5. A pair of semi-circular segments may thus be easily inserted into the respective grooves to provide the torque transmission between the bodies 12 and 14, without loading sleeve 40. Torque is thus transmitted from the upper body 12 through the ring 24 and then to the lower body 14. Torque shoulders on the first and second bodies may directly engage to transfer torque to the ball without loading the sleeve 40.

In other embodiments, one of the rotating sleeve 40 and the tab portion 52 of the torque transmitting member may include one or more projections which each fit within a corresponding helical slot in the other of the rotating sleeve and the connecting member tab portion 52, so that rotation of the sleeve 40 moves the connecting member 50 axially in the same manner as the threads 42 and 44 discussed above. Threads are preferred for most applications since they provide a large surface area for transmitting axial forces to the ball to open or close the ball.

As shown in FIG. 5, seal 59 is provided for sealing between the rotating sleeve and the first body 12, and a similar seal 56 is provided for sealing between the rotating sleeve and the second body. When the ball operates between the open and closed positions, seals 56 and 59 will prevent the fluid from escaping the valve between the outer bodies.

Figure 6:
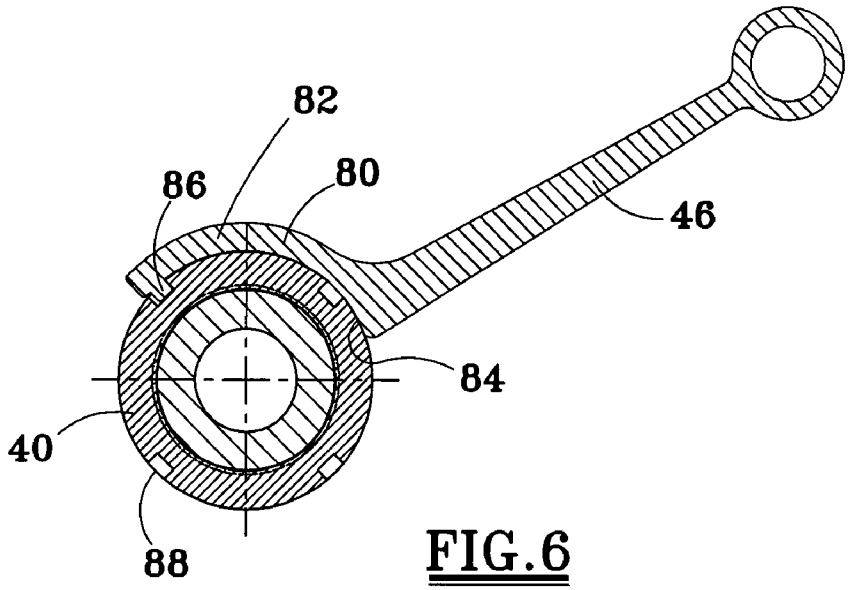
FIG. 6 is a cross-sectional view of the valve as shown in FIG. 1 and a suitable tool for operating the valve.

FIG. 6 shows a suitable tool 80 for engaging an outer surface of the actuator sleeve and rotating the actuator sleeve with respect to the first and second bodies. The exemplary tool has an arcuate portion 82 which substantially surrounds a portion of the actuator sleeve, with curved surface 84 engaging the exterior surface of sleeve 40, and at least one pin or lug 86 which fits within a respective cavity or recess 88 in the sleeve 40. Other types of tools may be used for rotating the sleeve, including a large pipe wrench.

According to one embodiment, the safety valve comprises a first generally tubular body having a first flow path therein, and a second generally tubular body having a second flow path therein axially aligned with the first flow path when the first and second bodies are mated. The ball is rotatable between open and closed positions for regulating flow between the first and second flow paths. A seat is provided for sealing between the first body and the ball when closed. A centering ring, which optionally may also be a seat, is spaced opposite the first seat and guides rotation of the ball. An outer actuator sleeve is rotatable with respect to the first and second bodies, and a connecting member between the actuator sleeve and the ball moves axially in response to rotation of the actuator sleeve to rotate the ball between the closed position and the open position.

Although specific embodiments of the invention have been described herein in some detail, this has been done solely for the purposes of explaining the various aspects of the invention, and is not intended to limit the scope of the invention as defined in the claims which follow. Those skilled in the art will understand that the embodiment shown and described is exemplary, and various other substitutions, alterations and modifications, including but not limited to those design alternatives specifically discussed herein, may be made in the practice of the invention without departing from its scope.

What is claimed is:

1. A safety valve, comprising:

a first generally tubular body having a first flow path therein;

a second generally tubular body having a second flow path therein axially aligned with the first flow path when the first and second bodies are mated;

a body connector for axially and rotatable interconnecting the first and second bodies;

a ball supported between the first and second bodies and having a flow path therein, the ball rotatable between an open position and a closed position for regulating flow between the first and second flow paths;

a first seat for sealing between the first body and the ball when closed;

a ball centering member for engaging the ball at a position axially opposite the first seat with respect to a center of the ball;

an outer actuator sleeve positioned between the first and second bodies and having an outer surface exposed to an exterior tool and rotatable with respect to the first and second bodies; and a connecting member acting between the actuator sleeve and the ball, the connecting member moving axially in response to rotation of the outer sleeve and thereby rotating the ball between the closed position and the open position.

2. A ball valve as defined in claim 1, further comprising:

a torque transmitting member acting between the first tubular body and the second tubular body for transferring torque between the tubular bodies while not imposing torque on the actuator sleeve.

3. A safety valve as defined in claim 2, wherein the torque transmitting member includes one or more arcuate ring segments spaced between torque shoulders on the first and second bodies.

4. A safety valve as defined in claim 1, wherein the centering member acts as a seat to seal between the ball and the second tubular body.

5. A safety valve as defined in claim 1, further comprising:

a tool for selectively engaging and disengaging an outer surface of the actuator sleeve and rotating the actuator sleeve with respect to the first and second bodies when engaged.

6. A safety valve as defined in claim 1, wherein the connecting member includes a pair of axially extending fingers which move axially to rotate the ball.

7. A safety valve as defined in claim 1, wherein the connecting member includes outer threads for mating with internal threads on the actuator sleeve, thereby axially moving the connecting member upon rotation of the actuator sleeve.

8. A safety valve, comprising:

a first generally tubular body having a first flow path therein;

a second generally tubular body having a second flow path therein axially aligned with the first flow path when the first and second bodies are mated;

a body connector for axially and rotatably interconnecting the first and second bodies;

a ball supported between the first and second bodies having a flow path therein and rotatable between an open position and a closed position for controlling flow between the first and second flow paths;

a first seat for sealing between the first body and the ball when closed;

a ball centering member for engaging the ball at a position axially opposite the first seat with respect to a center of the ball;

an outer actuator sleeve positioned between the first and second bodies and rotatable with respect to the first and second bodies, the outer actuator sleeve having an outer surface exposed to an exterior tool and having an outer diameter no greater than an outer diameter of each of the first and second tubular bodies;

a torque transmitting member acting between the first tubular body and the second tubular body for transferring torque between the tubular bodies while not imposing torque on the actuator sleeve; and a connecting member acting between the actuator sleeve and the ball, the connecting member including a pair of axially extending fingers moving axially in response to rotation of the outer sleeve and thereby rotating the ball between the closed position and the open position.

9. A safety valve as defined in claim 8, wherein the torque transmitting member includes one or more arcuate ring segments spaced in between torque shoulders on the first and second bodies.

10. A safety valve as defined in claim 8, wherein the centering member acts as a seat to seal between the ball and the second tubular body.

11. A safety valve as defined in claim 8, wherein the connecting member includes outer threads for mating with internal threads on the actuator sleeve, thereby axially moving the connecting member upon rotation of the actuator sleeve.

12. A safety valve as defined in claim 8, further comprising:

a tool for engaging an outer surface of the actuator sleeve and rotating the actuator sleeve with respect to the first and second bodies.

13. A method of operating a safety valve including a first generally tubular body having a first flow path therein, a second generally tubular body having a second flow path therein axially aligned with the first flow path when the first and second bodies are mated, and a ball supported between the first and second bodies and having a flow path therein, the ball rotatable between an open position and a closed position for controlling flow between the first and second flow paths, the method comprising:

axially and rotatably interconnecting the first and second bodies;

rotating an outer actuator sleeve positioned between the first and second bodies and having an outer surface exposed to an exterior tool and rotatable with respect to the first and second bodies; and providing a connecting member acting between the actuator sleeve and the ball, the connecting member moving axially in response to rotation of the outer sleeve and thereby rotating the ball between the closed position and the open position.

14. A method as defined in claim 13, further comprising:

providing a first seat for sealing between the first body and the ball when closed.

15. A method as defined in claim 13, further comprising:

providing a ball centering member for engaging the ball in a position axially opposite the first seat with respect to a center of the ball.

16. A method as defined in claim 13, further comprising:

providing a torque transmitting member acting between the first tubular body and the second tubular body for transferring torque between the tubular bodies while not imposing torque on the actuator sleeve.

17. A method as defined in claim 13, wherein the centering member acts as a seat to seal between the ball and the second tubular body.

18. A method as defined in claim 13, further comprising:

selectively engaging a tool with an outer surface of the actuator sleeve and rotating the actuator sleeve with respect to the first and second bodies.

19. A method as defined in claim 14, wherein the connecting member includes outer threads for mating with internal threads on the actuator sleeve, thereby axially moving the connecting member upon rotation of the actuator sleeve.

* * * * *

UNITED STATES PATENT AND TRADEMARK OFFICE

CERTIFICATE OF CORRECTION

PATENT NO. : 7,758,019 B2
APPLICATION NO. : 11/786495
DATED : July 20, 2010
INVENTOR(S) : Britt O. Braddick It is certified that error appears in the above-identified patent and that said Letters Patent is hereby corrected as shown below:

IN THE CLAIMS:

Column 4:
Line 48, Claim 1, please replace the word "rotatable" with --rotatably--.

Signed and Sealed this

Thirty-first Day of August, 2010

David J. Kappos

David J. Kappos
*Director of the United States Patent and Trademark Office*